US007446715B2

(12) United States Patent
Lim

(10) Patent No.: US 7,446,715 B2
(45) Date of Patent: Nov. 4, 2008

(54) MOBILE DISPLAY DEVICE

(75) Inventor: Seon-woo Lim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 126 days.

(21) Appl. No.: 11/368,844

(22) Filed: Mar. 7, 2006

(65) Prior Publication Data

US 2006/0202896 A1 Sep. 14, 2006

(30) Foreign Application Priority Data

Mar. 8, 2005 (KR) ..... 10-2005-0019352

(51) Int. Cl.
*H01Q 1/24* (2006.01)

(52) U.S. Cl. ..... 343/702; 343/906

(58) Field of Classification Search ..... 343/702, 343/906, 700 MS
See application file for complete search history.

(56) References Cited

U.S. PATENT DOCUMENTS

| | | | | |
|---|---|---|---|---|
| 5,508,709 | A * | 4/1996 | Krenz et al. | 343/702 |
| 5,513,383 | A * | 4/1996 | Tsao | 455/575.7 |
| 6,259,410 | B1 * | 7/2001 | Chang | 343/702 |
| 6,795,770 | B1 * | 9/2004 | Hanshew et al. | 701/213 |
| 2001/0019944 | A1 * | 9/2001 | Ida | 455/40 |
| 2004/0155822 | A1 * | 8/2004 | Lien | 343/702 |
| 2006/0162122 | A1 * | 7/2006 | Satoh et al. | 16/221 |

FOREIGN PATENT DOCUMENTS

| | | |
|---|---|---|
| JP | 2002-64329 | 2/2002 |
| JP | 2002-148325 | 5/2002 |
| JP | 2003-224412 | 8/2003 |
| KR | 1992-10205 | 11/1992 |
| KR | 1999-0021776 | 6/1999 |
| KR | 1999-0056102 | 7/1999 |
| KR | 20-0166583 | 10/1999 |
| KR | 2002-0078872 | 10/2002 |
| KR | 20-0326831 | 9/2003 |
| KR | 10-2004-0057660 | 7/2004 |
| KR | 20-0357855 | 11/2004 |
| KR | 2005-0026213 | 3/2005 |
| WO | WO 99/60660 | 11/1999 |
| WO | WO 00/27041 | 5/2000 |
| WO | WO 03/103173 | 12/2003 |

OTHER PUBLICATIONS

KR Office Action dated Aug. 21, 2006 issued in KR 2005-19352.
PCT Search Report dated Jun. 14, 2006.
International Search Report.

* cited by examiner

*Primary Examiner*—HoangAnh T Le
(74) *Attorney, Agent, or Firm*—Stanzione & Kim, LLP

(57) ABSTRACT

The present invention relates to a mobile display device including a main body; an antenna mounted on a side of the main body; a tilting shaft provided in one of the main body and the antenna; a tilting support provided in the other one of the main body and the antenna, and supporting the tilting shaft to tilt the antenna with respect to the main body; and an antenna accommodator provided in the main body to house the antenna which is tilted therein.

24 Claims, 4 Drawing Sheets

MOBILE DISPLAY DEVICE

CROSS-REFERENCE TO RELATED APPLICATION

This application claims priority to and the benefit of Korean Patent Application No. 10-2005-0019352, filed on Mar. 8, 2005, which is hereby incorporated by reference for all purposes as if fully set forth herein.

BACKGROUND OF THE INVENTION

1. Field of the Invention

The present invention relates to a mobile display device, and more particularly, to a mobile display device including an antenna that can be tilted against a main body.

2. Description of the Related Art

Generally, a mobile display device, such as a cellular telephone, PDA, portable computer, etc., may perform audio/video communication regardless of location.

Many types of mobile display devices are available, each of the mobile display devices is provided with at least one wireless communication service. For example, cellular phones and PDAs may be provided with various functions, such as wireless Internet, MP3, digital camera, broadcasting, telephone, etc.

As mobile display devices are becoming more popular, the demand for high quality digital broadcasting is increasing. Digital audio broadcasting (DAB) is beginning to replace the conventional AM or FM broadcasting. DAB technology operates different than existing AM or FM broadcasting in that DAB has excellent receiving capability and receives and sends digital data, such as motion pictures or text messages, a high speed while moving. Digital multimedia broadcasting (DMB) is similar to DAB; however, DMB relates to the broadcasting of multimedia.

Korean Utility Model Application No. 2003-20338 discloses a cellular phone that is mounted with an antenna to receive a digital multimedia broadcasting (DMB) signal. The cellular phone includes an antenna to receive the DMB signal, and a main body having a display part to display the received DMB signal.

Such configuration enables the DMB signal to be transmitted to the main body and output through the display part and/or a speaker. The antenna may be pulled out or extended in an area of poor signal (blanket area) for stable broadcasting or kept at a normal length in an area of sufficient signal (a non-blanket area). However, at the normal length, the antenna projects externally from the main body, thereby increasing the overall height of the cellular phone.

SUMMARY OF THE INVENTION

The present invention provides a mobile display device having a shape that minimizes a packaging size, thereby decreasing cost.

Additional features of the invention will be set forth in the description which follows, and in part will be apparent from the description, or may be learned by practice of the invention.

The present prevention discloses a device, including a main body; an antenna provided on a side of the main body; a tilting shaft provided in one of the main body and the antenna; a tilting support provided in the other one of the main body and the antenna, the tilting support supporting the tilting shaft to tilt the antenna with respect to the main body; and an antenna accommodator provided in the main body to receive the antenna which is tilted therein. The device may be a mobile display device, such as a cellular telephone.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DESCRIPTION OF THE ILLUSTRATED EMBODIMENT

Figure 1:
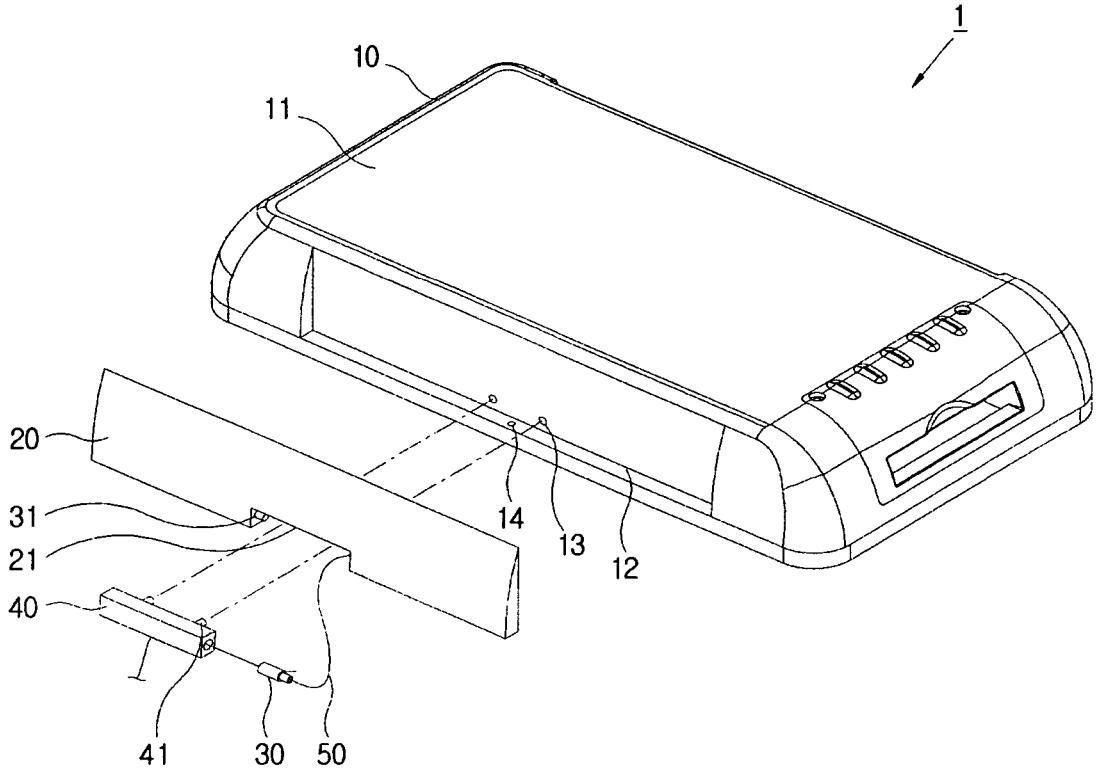
FIG. 1 is an exploded perspective view of a mobile display device according to an embodiment of the invention.
Figure 2:
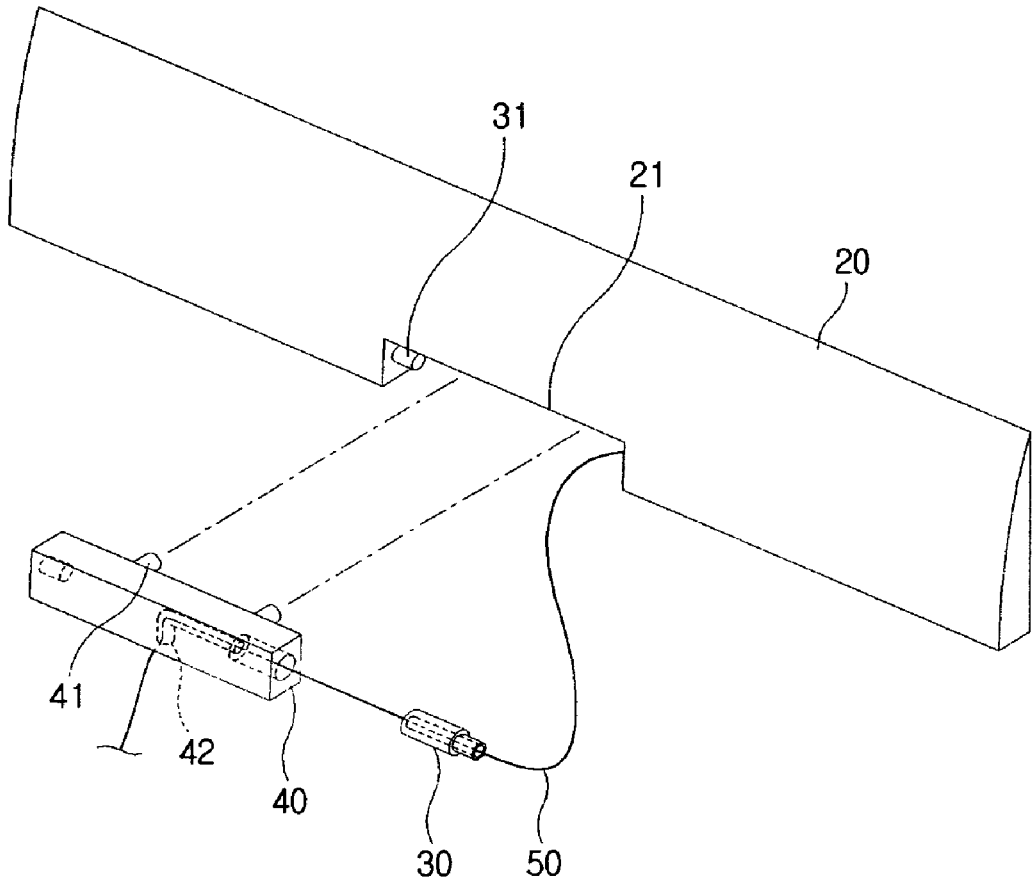
FIG. 2 is an enlarged perspective view of various parts of the mobile display device shown in FIG. 1.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

It is understood that when an element or layer is referred to as being "on" or "connected to" or "connected with" another element or layer, it can be directly on or directly connected to or with the other element or layer or intervening elements or layers may be present.

As shown in FIGS. 1, 2, 3, and 4, according to an embodiment of the present invention a mobile display device 1 includes a main body 10 having a main board; an antenna 20 mounted, attached, or connected on a first side of the main body 10; tilting shafts 30 and 31 coupled with or connected to the antenna 20; a tilting support 40 coupled with or connected to the main body 10 to support the tilting shafts 30 and 31 to tilt the antenna 20 against the main body 10; and an antenna accommodator 12 depressed or formed in the main body 10 to accommodate, to hold, house, or contain the antenna 20 which is tilted therein.

A display part (not shown) may be provided on a front surface of the main body 10 to display an image. A battery pack 11 may be mounted in or attached with the main body 10 to supply power. The antenna 20 may be mounted or provided in an upper surface of the main body 10. A main board (not shown) may be disposed in the main body 10, the main board including a driving circuit, a chip, etc.

It is understood that the position of the antenna 20 is not limited to that shown and described in the above embodiment. Alternatively, the antenna 20 may be provided in any one of the other sides of the main body 10.

The antenna accommodator 12 is depressed at or provided on a first side of the main body 10 to house the antenna 20. The antenna accommodator 12 may house the entire antenna 20. Thus, when the antenna 20 is in the operating position (refer to FIG. 4), the antenna 20 projects outside of the main body 10 by tilting the antenna outside of the antenna accommodator 12. When the antenna 20 is in the normal position (refer to FIG. 3), the antenna accommodator 12 houses the entire antenna 20 so that the antenna 20 is not projected outside of the main body 10. The antenna accommodator 12 may have a shape that corresponds with a shape of the antenna 20 so that the antenna accommodator 12 may house the entire antenna 20.

The antenna accommodator 12 includes a projection insertion hole 13 that receives a coupling projection 41, and a second cable through-hole 14 that connects a cable 50 with the main board of the main body 10.

The antenna 20 may receive a signal having a frequency for mobile communication or a signal having a frequency for DMB or DAB. The antenna 20 may have a substantially plate-like shape, and the antenna accommodator 12 may have a corresponding shape. A first tilting shaft 30 is coupled with a first side of the antenna 20. A second shaft insertion hole (not shown) is formed on a second side of the antenna 20 to perceive a second tilting shaft 31 (to be described later). A tilting support coupler 21 is formed on a central part of the antenna 20 to couple with a tilting support 40. However, the position of the tilting support coupler 21 is not limited thereto. Alternatively, the tilting support coupler 21 may be provided along any area of the antenna 20 as long as it couples with the tilting support 40.

The first tilting shaft 30 includes a first end thereof that is inserted to one side of the titling support coupler 21 and an opposite end thereof that is inserted to a side of the titling support 40. The second tilting shaft 31 includes a first end thereof that is inserted to a side of the tilting support coupler 21 opposite to the first tilting shaft, and a second end thereof that is inserted to an opposite side of the tilting support 40 than the first end.

The tilting support 40 is detachably attached with or coupled with the main body 10, and can be coupled with or separated from the antenna accommodator 12. For example, the tilting support 40 may be formed with the coupling projection 41 which projects or extends toward the antenna accommodator 12. The antenna accommodator 12 is formed with the projection insertion hole 13 to be inserted with the coupling projection 41.

The mobile display device 1 may further include a wire or cable 50 having a first end thereof connected with the antenna 20 and a second end thereof connected with the main body 10.

The cable 50 may pass through the inside of the first tilting shaft 30 and the tilting support 40 from the antenna 20 to connect with the main body 10. The tilting support 40 is formed with a first cable through-hole 42 to connect the cable 50 to the main body 10. Accordingly, the cable 50 may connect with the main board of the main body 10 after passing through the first cable through-hole 42 and the second cable through-hole 14.

Figure 3:
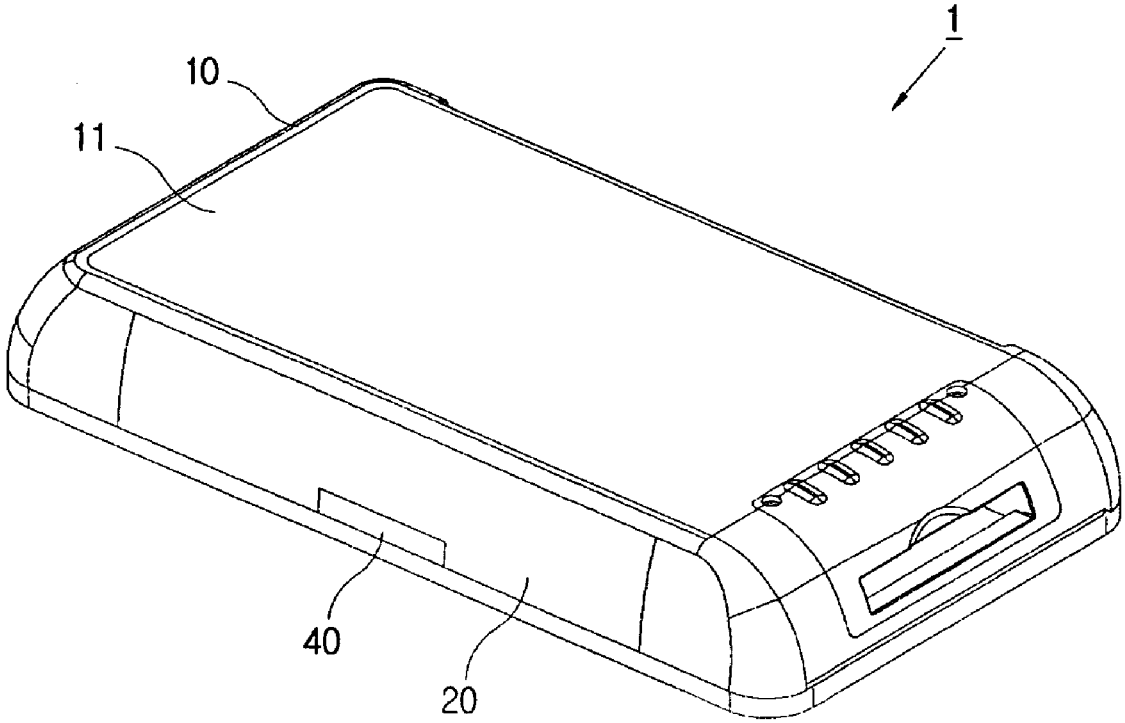
FIG. 3 is a coupling perspective view of the mobile display device shown in FIG. 1.
Figure 4:
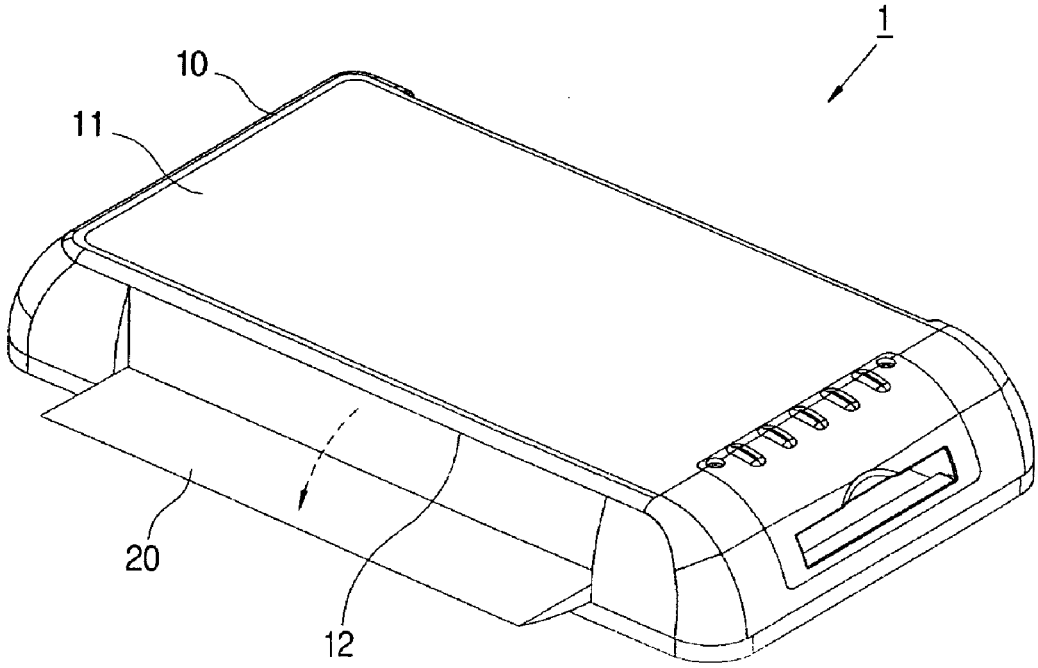
FIG. 4 is a perspective view of an antenna tilting from a main body of the mobile display device shown in FIG. 3.

According to at least the above described embodiment of the invention, the configuration of the mobile display device 1 presents a good external appearance and minimizes a packaging size because the antenna 20 is not externally projected with respect to the main body 10, as shown in FIG. 3. Also, the antenna 20 may be tilted with respect to the main body 10 without difficulty to receive a broadcasting signal.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A device, comprising:

a main body having a front surface, a rear surface and a side surface;

an antenna provided on the side surface of the main body;

a tilting shaft provided in one of the main body and the antenna;

a tilting support provided in the other one of the main body and the antenna, the tilting support supporting the tilting shaft to tilt the antenna with respect to the main body; and an antenna accommodator provided in the side surface of the main body to accommodate the antenna which is tilted therein and the tilting support, wherein the side surface has a smaller width than the front surface and the rear surface.

2. The device of claim 1, wherein the antenna accommodator houses the entire antenna.

3. The device of claim 1, wherein the antenna comprises substantially plate-like shape.

4. The device of claim 2, wherein the tilting support is detachably attached with the antenna accommodator, and the antenna is formed with a tilting support coupler to couple with the tilting support.

5. The device of claim 1, further comprising:

a cable having a first end thereof that is connected with the antenna and a second end thereof that is connected with the main body, wherein the cable passes through an inside of the tilting shaft and the tilting support to be coupled with the main body.

6. The device of claim 1, wherein the antenna receives a digital multimedia broadcasting signal.

7. The device of claim 1, wherein the antenna does not project from the main body when the antenna is not tilted.

8. The device of claim 1, wherein the antenna accommodator and the antenna comprise substantially a same shape.

9. The device of claim 1, wherein the device is a mobile communication device.

10. The device of claim 9, wherein the mobile communication device has a large display area.

11. The device of claim 10, wherein the mobile communication device is a mobile phone.

12. The device of claim 10, wherein the mobile communication device is a personal digital assistant (PDA).

13. The device of claim 10, wherein the mobile communication device is a portable computer.

14. The device of claim 1, further including a display part provided on the front surface of the main body, and a battery pack installed on the rear surface of the main body.

15. The device of claim 14, wherein the antenna accommodator is provided in an upper surface of the side surface.

16. A mobile communication device, comprising:

a main body having a front and a rear surface and four side surfaces;

an antenna disposed on one of the side surfaces of the main body and having at least one tilting shaft disposed thereon to tilt the antenna with respect to the main body and the tilting shaft;

a tilting support to receive and to support the at least one tilting shaft to tilt the antenna and having at least one coupling projection disposed thereon to couple to one of the side surfaces of the main body; and an antenna accommodator provided in the one of the side surfaces of the main body to accommodate the antenna and the tilting support, wherein the side surface has a smaller width than the front surface and the rear surface.

17. The mobile communication device of claim 16, wherein a plurality of tilting shafts are disposed on the antenna.

18. The mobile communication device of claim 17, wherein the tilting support supports and receives the plurality of tilting shafts.

19. The mobile communication device of claim 16, further including at least one projection insertion hole disposed on the one of the side surfaces of the main body to receive the at least one coupling projection.

20. The mobile communication device of claim 16, wherein a plurality of coupling projections are disposed on the tilting support.

21. The mobile communication device of claim 20, wherein a plurality of projection insertion holes are disposed on the one of the side surfaces of the main body to receive the plurality of coupling projections.

22. The mobile communication device of claim 16, further including a cable having a first end to pass through the device main body and a second end to pass through the at least one tilting shaft and to electrically connect to the antenna.

23. The device of claim 16, further including a display part provided on the front surface of the main body, and a battery pack installed on the rear surface of the main body.

24. The device of claim 23, wherein the antenna accommodator is provided in an upper surface of the side surface.

* * * * *